US011976544B2

(12) United States Patent
Martinez

(10) Patent No.: US 11,976,544 B2
(45) Date of Patent: May 7, 2024

(54) DETERMINING A TECHNICAL LIMIT FOR A DRILLING OPERATION USING A MACHINE LEARNING ALGORITHM

(71) Applicant: Landmark Graphics Corporation, Houston, TX (US)

(72) Inventor: Damian Antonio Martinez, Bogota (CO)

(73) Assignee: Landmark Graphics Corporation, Houston, TX (US)

( * ) Notice: Subject to any disclaimer, the term of this patent is extended or adjusted under 35 U.S.C. 154(b) by 33 days.

(21) Appl. No.: 17/344,031

(22) Filed: Jun. 10, 2021

(65) Prior Publication Data

US 2022/0025756 A1 Jan. 27, 2022

Related U.S. Application Data

(60) Provisional application No. 63/054,882, filed on Jul. 22, 2020.

(51) Int. Cl.

| | |
|---|---|
| ***E21B 44/00*** | (2006.01) |
| ***E21B 44/02*** | (2006.01) |
| ***E21B 47/04*** | (2012.01) |
| ***E21B 49/00*** | (2006.01) |
| *E21B 47/12* | (2012.01) |

(52) U.S. Cl.

CPC ..... *E21B 44/02* (2013.01); *E21B 47/04* (2013.01); *E21B 49/003* (2013.01); *E21B 47/12* (2013.01)

(58) Field of Classification Search

CPC ..... E21B 43/003; E21B 49/003

See application file for complete search history.

(56) References Cited

U.S. PATENT DOCUMENTS

| | | | | |
|---|---|---|---|---|
| 4,780,857 | A | 10/1988 | Lyle et al. | |
| 2013/0080117 | A1 | 3/2013 | Liu et al. | |
| 2018/0087351 | A1 | 3/2018 | Johnston et al. | |
| 2019/0242236 | A1 * | 8/2019 | Samuel | G07C 3/08 |
| 2020/0116887 | A1 * | 4/2020 | Vinay | E21B 47/13 |

OTHER PUBLICATIONS

Weatherford, "Centro Well Construction Optimization Platform", Data Sheet, available at https://weatherford.com/centro at least as early as Jul. 7, 2020, 8 pages.

Halliburton/Landmark, "DecisionSpace® 365 is a Cloud-Based, Subscription Service for E&P Applications to Empower You to be Creative and Help Realize Your Objectives", Data Sheet, available at www.landmark.solutions.com at least as early as Jul. 7, 2020, 3 pages.

(Continued)

*Primary Examiner* — Giovanna Wright

(74) *Attorney, Agent, or Firm* — Kilpatrick Townsend & Stockton LLP

(57) ABSTRACT

A system can determine an accurate technical limit for a wellbore drilling operation using machine learning. A computing device can receive real-time data of the wellbore drilling operation; apply a machine-learning algorithm to the real-time data to determine a lost connection of the wellbore drilling operation; apply the machine-learning algorithm to determine correlations between the real-time data and historic drilling reports; and determine the technical limit for the wellbore drilling operation based on the correlations.

18 Claims, 5 Drawing Sheets

(56) References Cited

OTHER PUBLICATIONS

Halliburton/Landmark, "DecisionSpace® InSite® Software Data Sheet", Data Sheet, available at www.landmarksoftware.com at least as early as Jul. 7, 2020 4 pages.
Drilling Contractor, "Deconstructing Invisible Lost Time: KPIs, Analytics, Standardization Improve Well Deliveries in Bakken", available at https://www.drillingcontractor.org/deconstructing-invisible-lost-time-kpis-analytics-standardization-improve-well-deliveries-in-bakken-44170, Sep. 5, 2017, 5 pages.
Nabors, "Drilling Data & Analytics", available at https://www.nabors.com/software/drilling-data-analytics at least as early as Jul. 22, 2020, 4 pages.
Halliburton, "DecisionSpace® Drilling Analytics—Leveraging Historical Drilling Data is Critical for Optimizing Newer Drilling Operations", available at https://www.petromehras.com/petroleum-software-directory/drilling-completion-software/decisionspace-drilling-analytics at least as early as July 7, 202, 6 pages.
Baker Hughes, "WellLink RT Service—Optimize Drilling Operations with Real-time Visualization and Analysis of Data", Mar. 2014, 2 pages.
Konsberg Digital, "Sitecom—Real-time Drilling", available at https://www.konogsberg.com/digital/products/sitecom/ at least as early as Jul. 7, 2020, 4 pages.
Halliburton/Landmark, "Real-Time Well Engineering", Data Sheet, available at www.landmark.solutions at least as early as Jul. 7, 2020, 2 pages.
Schlumberger Software, "RigHour Multiwell Drilling Performance Analysis Service", Data Sheet, available at www.software.slb.com/services at least as early as Jul. 7, 2020 2 pages.
M/D Totco, "WellData and WellData RT Real-Time Systems", Data Sheet, available at www.nov.com/MDTotco at least as early as Jul. 7, 2020, 1 page.
Al-Ghunaim et al., "Operations Efficiency: Improved Well Planning Methodology Based on Invisible Lost Time Smart KPIs", SPE-183941-MS, Society of Petroleum Engineers, Mar. 6-9, 2017, 21 pages.
Jantzen et al., "Wellsite Information Transfer Specification (WITS) for Digital Rig-Site Data", SPE-16141-PA, SPE Drilling Engineering, Society of Petroleum Engineers, Dec. 1989, pp. 291-299.
Madasu et al., "Deep Recurrent Neural Network DRNN Model for Real-Time Multistage Pumping Data", OTC Arctic Technology Conference,, Nov. 5-7, 2018, 10 pages.
Ouahrani et al., "Invisible Lost Time Measurement and Reduction Contributes to Optimizing Total Well Time by Improving ROP and Reducing Flat Time", SPE-192319-MS, SPE Kingdom of Saudi Arabia Annual Technical Symposium and Exhibition, Society of Petroleum Engineers, Apr. 23-26, 2018, 15 pages.
Pessier et al., "Drilling Performance is a Function of Power at the Bit and Drilling Efficiency", Analyzing Drilling Mechanics, SPE-151389-MS, Society of Petroleum Engineers, Apr. 2012, pp. 74-80.
GB Application No. GB2108571.7 , "Combined Search and Examination Report", dated Nov. 11, 2021, 8 pages.

* cited by examiner

DETERMINING A TECHNICAL LIMIT FOR A DRILLING OPERATION USING A MACHINE LEARNING ALGORITHM

CROSS REFERENCE TO RELATED APPLICATION

This application claims priority to U.S. Application No. 63/054,882, titled "Determining a Technical Limit for a Drilling Operation Using a Machine Learning Algorithm" and filed Jul. 22, 2020, the entirety of which is incorporated herein by reference.

TECHNICAL FIELD

The present disclosure relates generally to wellbore drilling operations and, more particularly (although not necessarily exclusively), to determining a technical limit of a drilling operation using a machine-learning algorithm.

BACKGROUND

Drilling operations may use a number of technologies to determine data from downhole regarding an engineering operation or a subterranean formation. These tools can transmit drilling data during the duration of a drilling operation. For example, a length of time of the drilling operation can coincide with an amount of time spent transmitting drilling data via well tools without interference from network devices or other external events. But, data transmission can fail or contain noise causing the data to be missing or difficult to analyze, which can cause problems of efficiency in executing or completing the drilling operation or in analyzing the generated data.

DETAILED DESCRIPTION

Figure 1:
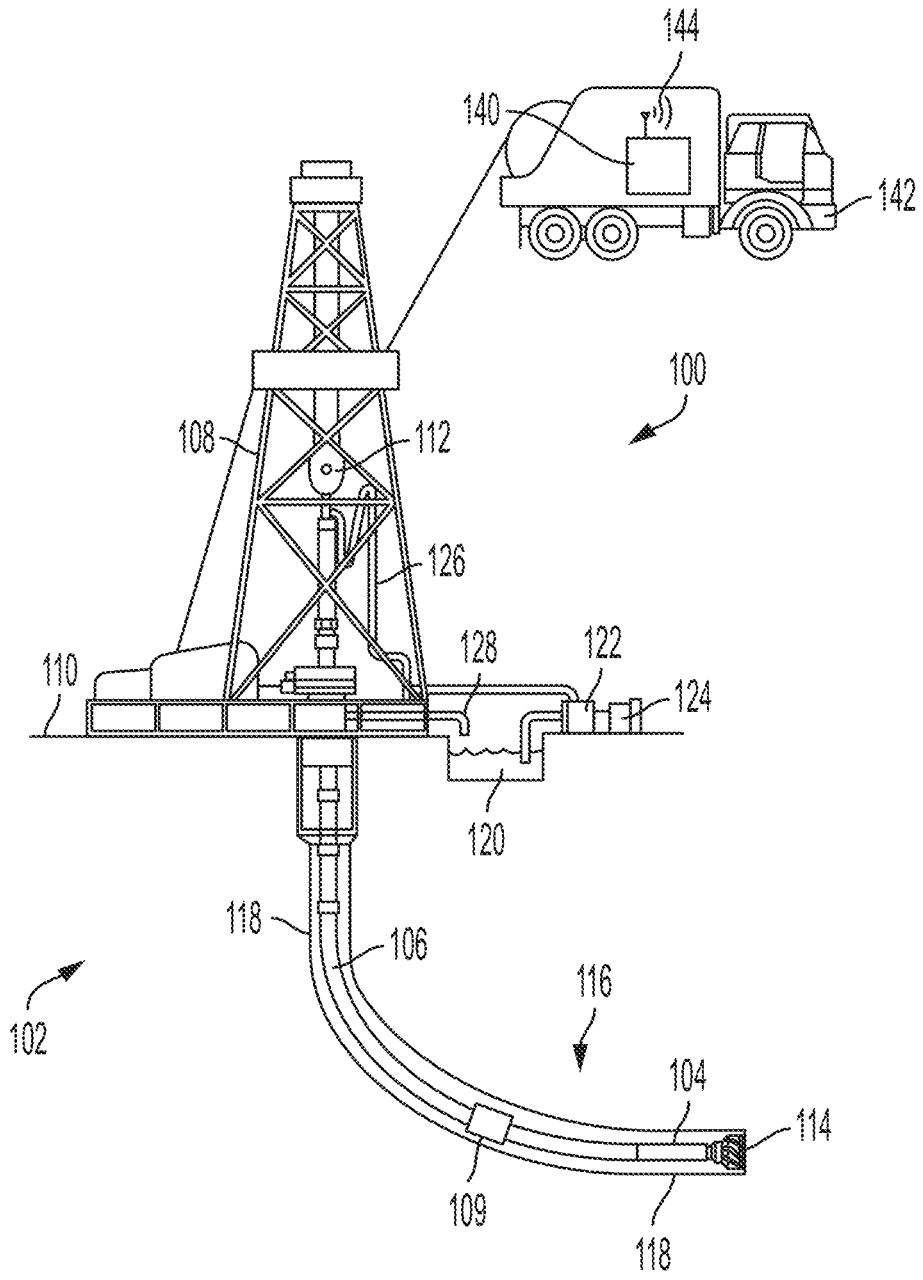
FIG. 1 is a cross-sectional view of a wellbore drilling system that can determine a technical limit of a drilling operation according to one example of the present disclosure.

Certain aspects and features of the present disclosure relate to determining a technical limit for a drilling operation using machine learning. The technical limit can be an amount of time determined for a drilling operation that corresponds to a theoretical maximum in safety, efficiency, and productivity for the drilling operation. The drilling operation can provide real-time data from which drilling connections can be determined. Drilling connections can include successful connections and lost connections. Successful connections can be when data is successfully transmitted from downhole, and lost connections can be when data that is transmitted that is too noisy to analyze is transmitted from downhole, or gaps in the real-time data of the drilling operation. The gaps may occur due to a loss of network connection during the drilling operation. The machine learning for determining the technical limit can include determining lost connections associated with the drilling operation.

Problems can occur during the drilling operation that can cause a difference between an actual duration of the drilling operation and the technical limit. The difference between the actual duration of the drilling operation and the technical limit can be an invisible lost time (ILT) for the drilling operation. The drilling operation can be a drilling operation using drilling slips or any other suitable type of operation for determining a technical limit. For example, the technical limit can be determined according to slip-to-slip time, which can represent the time spent between setting a string into a slips and picking the string out of the slips again.

Some examples of the present disclosure can provide improved drilling operations. The problems that occur during the drilling operation can affect data transmission and cause gaps in real-time data during data transmission. Gaps in real-time data can impact the results of the data processing and can lead to incomplete analyses of the data. The technical limit can be determined by reducing noise of data lost due to problems at the rig. Since the difference between the actual duration and the technical limit of the drilling operation can result in invisible lost time for the drilling operation, an ILT analysis can be inaccurate if the rig experienced any of the previously described issues during the data transmission. The present disclosure can accurately determine the technical limit by applying machine learning to real-time data. Accurate determinations of the technical limit can aid an operator of the drilling operation to reduce the invisible lost time and increase the productivity of the drilling operation.

The technical limit can be determined using a machine-learning algorithm, where a variation of the technical limit over time changes by depth. A data-mining algorithm may be used to analyze drilling connections to determine if the connections made are complete or not. The algorithm can calculate the missing connections according to the rig stand, depths, and historical behaviors. The machine-learning algorithm can determine the technical limit of the drilling operation by evaluating correlations between several real-time data variables and historical daily drilling reports (e.g., technological details and non-productive time reports). By correlating the real-time data with the historical drilling reports, the machine-learning algorithm can determine the technical limit of the drilling operation based on the connections.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a wellbore drilling system 100 that can determine a technical limit of a drilling operation according to one example of the present disclosure.

A wellbore 118 used to extract hydrocarbons may be created by drilling into a subterranean formation 102 using the drilling system 100. The drilling system 100 may include a bottom hole assembly (BHA) 104 positioned or otherwise arranged at the bottom of a drill string 106 extended into the subterranean formation 102 from a derrick 108 arranged at the surface 110. The derrick 108 includes a kelly 112 used to lower and raise the drill string 106. The BHA 104 may include a drill bit 114 operatively coupled to a tool string 116, which may be moved axially within the wellbore 118 as attached to the drill string 106. Tool string 116 may include one or more sensors 109, for determining conditions in the wellbore. Sensors 109 may be positioned on drilling equipment and sense values of drilling parameters for a drilling operation. The sensors can send signals to the surface 110 via a wired or wireless connection, and the sensors may send real-time data relating to the drilling operation to the surface 110. The combination of any support structure (in this example, derrick 108), any motors, electrical equipment, and support for the drill string and tool string may be referred to herein as a drilling arrangement.

During operation, the drill bit 114 penetrates the subterranean formation 102 and thereby can create the wellbore 118. The BHA 104 provides control of the drill bit 114 as it advances into the subterranean formation 102. The combination of the BHA 104 and drill bit 114 can be referred to as a drilling tool. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drill string 106, and hole cleaning can occur which involves returning the drill cuttings and debris to the surface. The cuttings and mud mixture are passed through a flow line 128 and are processed such that a cleaned mud is returned down hole through the stand pipe 126 once again.

The drilling arrangement and any sensors (through the drilling arrangement or directly) can be connected to a computing device 140. In FIG. 1, the computing device 140 is illustrated as being deployed in a work vehicle 142; however, a computing device to receive data from sensors and to control drill bit 114 can be permanently installed with the drilling arrangement, be hand-held, or be remotely located. Although one computing device 140 is depicted in FIG. 1, in other examples, more than one computing device can be used, and together, the multiple computing devices can perform operations, such as those described in the present disclosure.

The computing device 140 can include a processor interfaced with other hardware via a bus. A memory, which can include any suitable tangible (and non-transitory) computer-readable medium, such as random-access memory ("RAM"), read-only memory ("ROM"), electrically erasable and programmable read-only memory ("EEPROM"), or the like, can embody program components that configure operation of the computing device 140. In some aspects, the computing device 140 can include input/output interface components (e.g., a display, printer, keyboard, touch-sensitive surface, and mouse) and additional storage.

The computing device 140 can include a communication device 144. The communication device 144 can represent one or more of any components that facilitate a network connection. In the example shown in FIG. 1, the communication devices 144 are wireless and can include wireless interfaces such as IEEE 802.11, Bluetooth, or radio interfaces for accessing cellular telephone networks (e.g., transceiver/antenna for accessing a CDMA, GSM, UMTS, or other mobile communications network). In some examples, the communication devices 144 can use acoustic waves, surface waves, vibrations, optical waves, or induction (e.g., magnetic induction) for engaging in wireless communications. In other examples, the communication device 144 can be wired and can include interfaces such as Ethernet, USB, IEEE 1394, or a fiber optic interface. In an example with at least one other computing device, the computing device 140 can receive wired or wireless communications from the other computing device and perform one or more tasks based on the communications. For example, the computing device 140 can be used to determine the technical limit during the drilling operation based on real-time data from the drilling operation.

Figure 2:
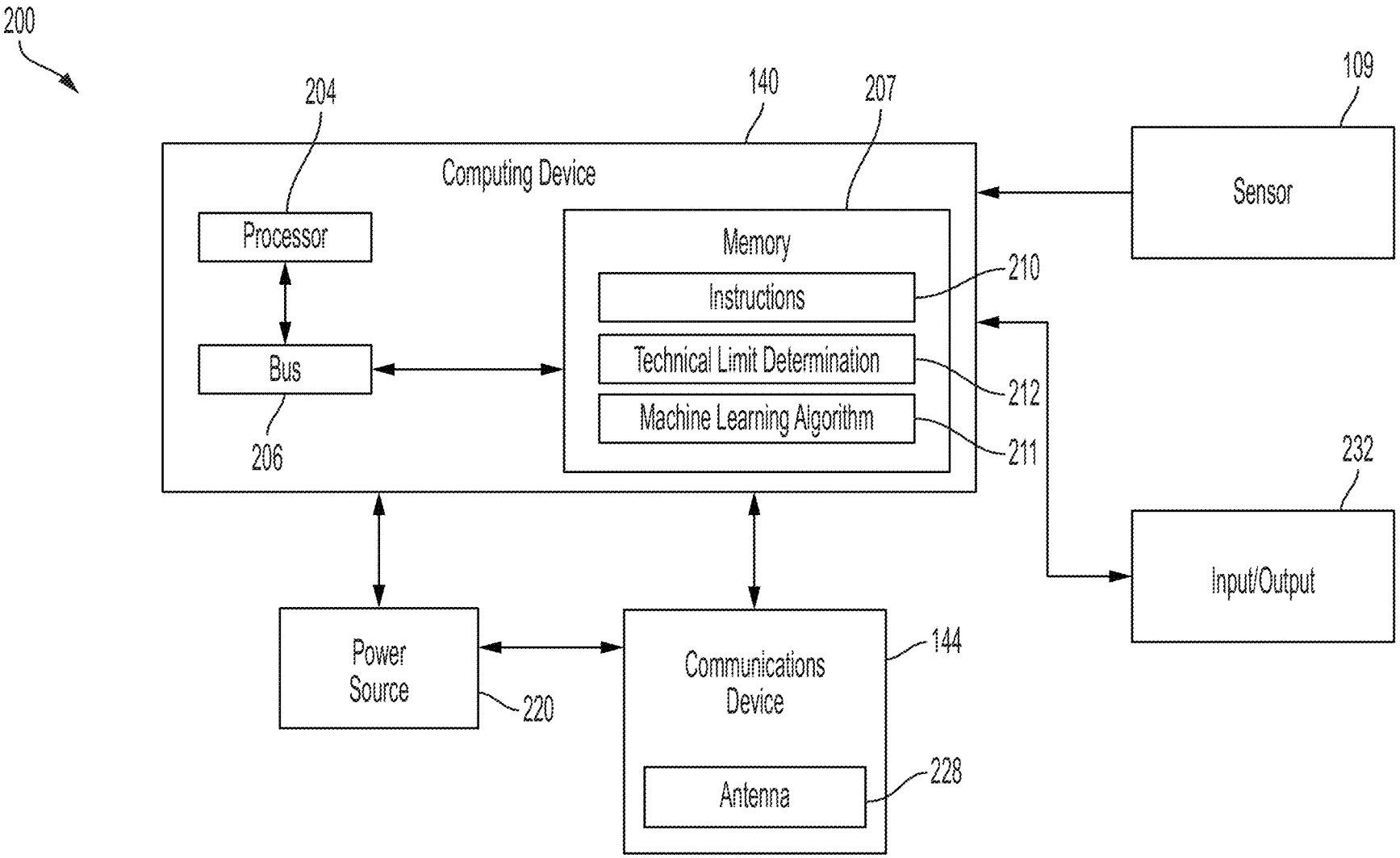
FIG. 2 is a block diagram of a computing system for determining a technical limit of a drilling operation using a machine-learning algorithm.

FIG. 2 is a block diagram of a computing system 200 for determining a technical limit of a drilling operation using a machine-learning algorithm.

The computing system 200 includes the computing device 140. The computing device 140 can include a processor 204, a memory 207, and a bus 206. The computing device 140 can execute instructions 210 for determining the technical limit. The processor 204 can execute one or more operations for automatically controlling the drilling operation. The processor 204 can execute instructions stored in the memory 207 to perform the operations. The processor 204 can include one processing device or multiple processing devices or cores. Non-limiting examples of the processor 204 include a Field Programmable Gate Array ("FPGA"), an application-specific integrated circuit ("ASIC"), a microprocessor, etc.

The processor 204 can be communicatively coupled to the memory 207 via the bus 206. The non-volatile memory 207 may include any type of memory device that retains stored information when powered off. Non-limiting examples of the memory 207 include EEPROM, flash memory, or any other type of non-volatile memory. In some examples, at least part of the memory 207 can include a medium from which the processor 204 can read instructions. A computer-readable medium can include electronic, optical, magnetic, or other storage devices capable of providing the processor 204 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C #, etc.

In some examples, the memory 207 can include computer program instructions 210 for applying a machine-learning algorithm 211 to determine a technical limit 212. The technical limit 212 can be stored in the memory 207. A sensor 109 can be deployed downhole and detect and transmit real-time data to the computing device 140. The real-time data can include measurements such as azimuth, temperature, pressure, revolutions per minute, torque on bit, weight on bit, or a combination thereof. The computing device 140 can provide the real-time data to the machine-learning algorithm 211. The machine-learning algorithm 211 can detect connection activity from the real-time data it receives. The machine-learning algorithm 211 can determine connection classifications for the real-time data by determining if a connection was made or not. For example, the machine-learning algorithm 211 may determine gaps in the real-time data that correspond to lost connections. The machine-learning algorithm 211 can receive and use predefined patterns of historical drilling data to detect the lost connections. The connection classifications may additionally include a classification for successful connections.

The machine-learning algorithm 211, or a different machine-learning algorithm, may generate drilling data or determine a total minimal connection for the lost connections. For example, the machine-learning algorithm 211 can perform correlation analysis to generate drilling data. The correlation analysis can involve the machine-learning algorithm 211 receiving and correlating the real-time data to historic drilling data. The machine-learning algorithm 211 can then determine, based on the historic drilling data and the correlations, predicted drilling data that can be included in the gaps of the lost connections. The machine-learning algorithm 211 can then use a data-mining process using real-time data, the drilling connection classifications (e.g., successful connection or missed connection), the predicted drilling data for the lost connections, and rig stand length to determine the technical limit 212.

In some examples, the machine-learning algorithm 211 can also determine variations of the technical limit 212 according to a depth of the wellbore. For example, the machine-learning algorithm 211 can detect changes in connection activity or rig variation according to depth and update the technical limit 212 according to the detected changes during the drilling operation. Examples of such activity can include bit connection, bottom hole assembly (BHA) changes, or other activities. The machine-learning algorithm 211 can test modeling hypotheses under given drilling conditions. In some examples, there can be multiple technical limit variations for the wellbore concurrently. For example, the technical limit 212 can be a first technical limit for a first depth plane and additional technical limits may be determined that each correspond to another depth plane of the wellbore.

In some examples, the machine-learning algorithm 211 can differentiate time portions of the drilling operation (e.g., technical limit 212, ILT, and non-productive time). In some examples, the technical limit 212 can be used to estimate a total minimal connection according to a depth range of a wellbore. The total minimal connection can be an estimated quantity and time associated with the lost connections in different depth ranges of the wellbore. In some examples, a total duration time (i.e. actual duration), the perfect well time, the invisible lost time, and the conventional non-productive time for the drilling operation can also be determined based on the technical limit 212. For example, the total duration time for the drilling operation can include the perfect well time, invisible lost time, and the conventional non-productive time.

In some examples, the machine-learning algorithm 211 can identify an accurate invisible lost time of the drilling operation by accounting for the variability of different aspects involved in drilling connections. The invisible lost time calculation may include custom or automatic data replacement to increase the accuracy of the calculation. A final user can obtain the information about the drilling connections for the well to identify how much time is associated to the ILT. The user may additionally identify which part of the well has the highest ILT. By identifying the well section with highest ILT, this section can be surveilled for future drilling operations to determine how to reduce the potentially high ILT. Additionally, each connection of the drilling operation can be monitored to determine how much invisible lost time is associated with each connection. This determination can allow users to perform operations to reduce the invisible lost time for connections with high invisible lost times.

In some examples, the computing device 140 can output a command to cause an adjustment of the wellbore drilling operation based on the invisible lost time. In some examples, the machine-learning algorithm 211 can determine the technical limit 212 for the depth of the wellbore is outside of a predefined range. In response to determining the technical limit 212 for the depth is outside of the predefined range, the computing device 140 can output the command to cause the adjustment of the wellbore drilling operation. In some examples, the computing device 140 can provide near to real-time auto-adjustment using non-productive time daily reports.

The computing system 200 can include a power source 220. The power source 220 can be in electrical communication with the computing device 140 and the communications device 144. In some examples, the power source 220 can include a battery or an electrical cable (e.g., a wireline). In some examples, the power source 220 can include an AC signal generator. The computing device 140 can operate the power source 220 to apply a transmission signal to the antenna 228 to forward data relating to drilling parameters, connections, etc. to other systems. For example, the computing device 140 can cause the power source 220 to apply a voltage with a frequency within a specific frequency range to the antenna 228. This can cause the antenna 228 to generate a wireless transmission. In other examples, the computing device 140, rather than the power source 220, can apply the transmission signal to the antenna 228 for generating the wireless transmission.

In some examples, part of the communications device 144 can be implemented in software. For example, the communications device 144 can include additional instructions stored in memory 207 for controlling functions of the communication device 144. The communications device 144 can receive signals from remote devices and transmit data to remote devices. For example, the communications device 144 can transmit wireless communications that are modulated by data via the antenna 228.

The computing system 200 can receive input, such as the real-time data, from sensor(s) 109. The computing system 200 in this example also includes input/output interface 232. Input/output interface 232 can connect to a keyboard, pointing device, display, and other computer input/output devices. An operator may provide input using the input/output interface 232. The technical limit 212 can be included in a display that is outputted via the input/output interface 232.

In some examples, the components shown in FIG. 2, e.g., the computing device 140, power source 220, and communications device 144, can be integrated into a single structure. For example, the components can be within a single housing. In other examples, the components shown in FIG. 2 can be distributed, such as in separate housings, and in electrical communication with each other.

Figure 3:
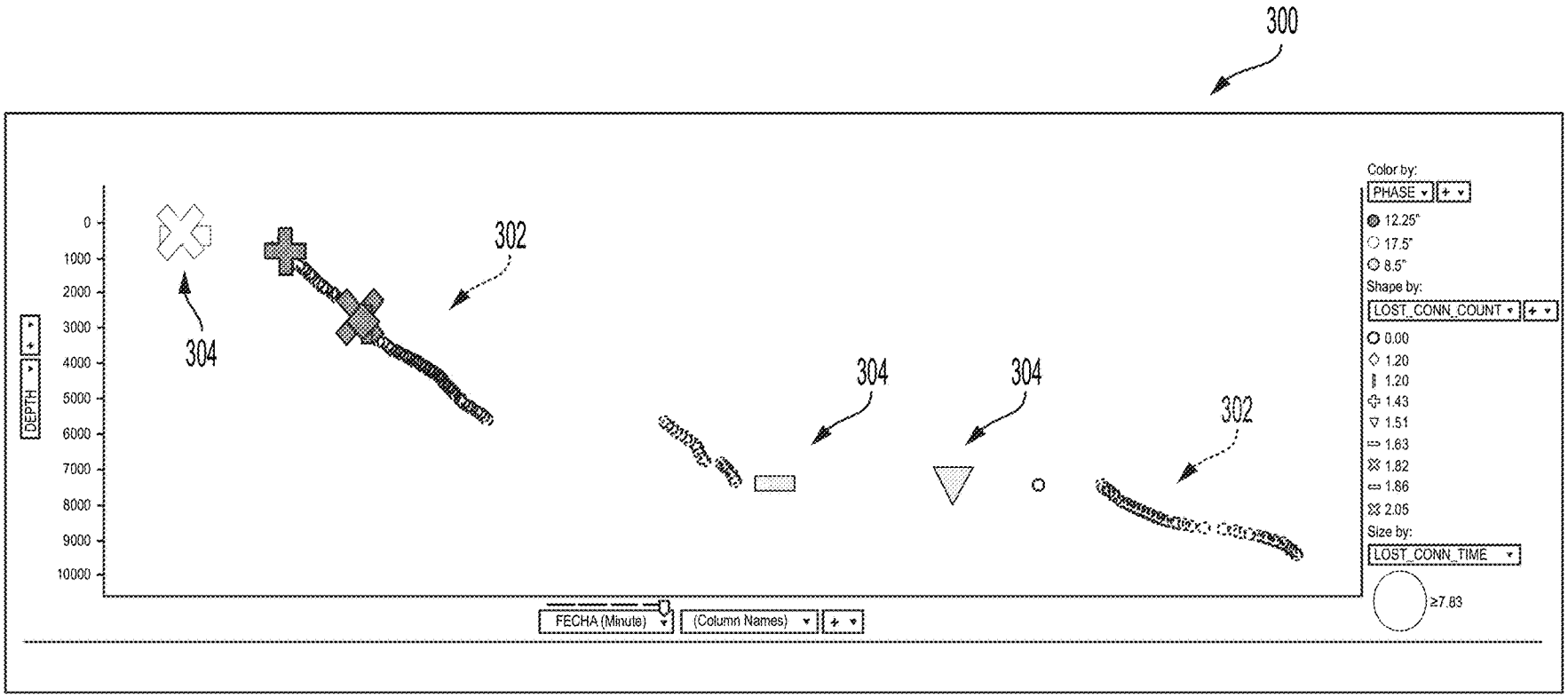
FIG. 3 is a diagram of lost connection detection by depth during a drilling operation according to one example of the present disclosure.

FIG. 3 is a graph 300 of lost connection detection by depth during a drilling operation according to one example of the present disclosure.

A machine-learning algorithm can define lost connections through a data-mining process. The machine-learning algorithm can use real-time data, drilling connection classifications (e.g., successful connection or lost connection), and rig stand length to estimate a total minimal connection in a depth range of a wellbore. The machine-learning algorithm can also determine the technical limit from the real-time data and lost connections.

In FIG. 3, circles that are not filled in represent connection activities in the real-time data during the drilling operation. The other symbols represent results of the machine-learning algorithm, which show the quantity and time of lost connections that can be filled by the machine-learning algorithm. Section changes, such as between initial, intermediate, and final hole sections, may also be represented in the graph.

While the graph 300 shows lost connection detection results by depth, a graph of depth variation between connections versus the rig stand may also be used. In such examples, the machine-learning algorithm can detect connections using a standard duration and depth variation, where the drilling operation activity suggests a bit connection, BHA changes, or other activities.

The graph 300 shows an output of the machine-learning algorithm detecting connection activities within the real-time data. First circles 302 represent successful connection activities in the real-time data during the drilling operation. The other symbols 304 show the quantity and time of lost connections. The machine-learning algorithm can correlate the lost connections of the real-time data and the historical reports to generate predicted data to fill the lost connections.

Figure 4:
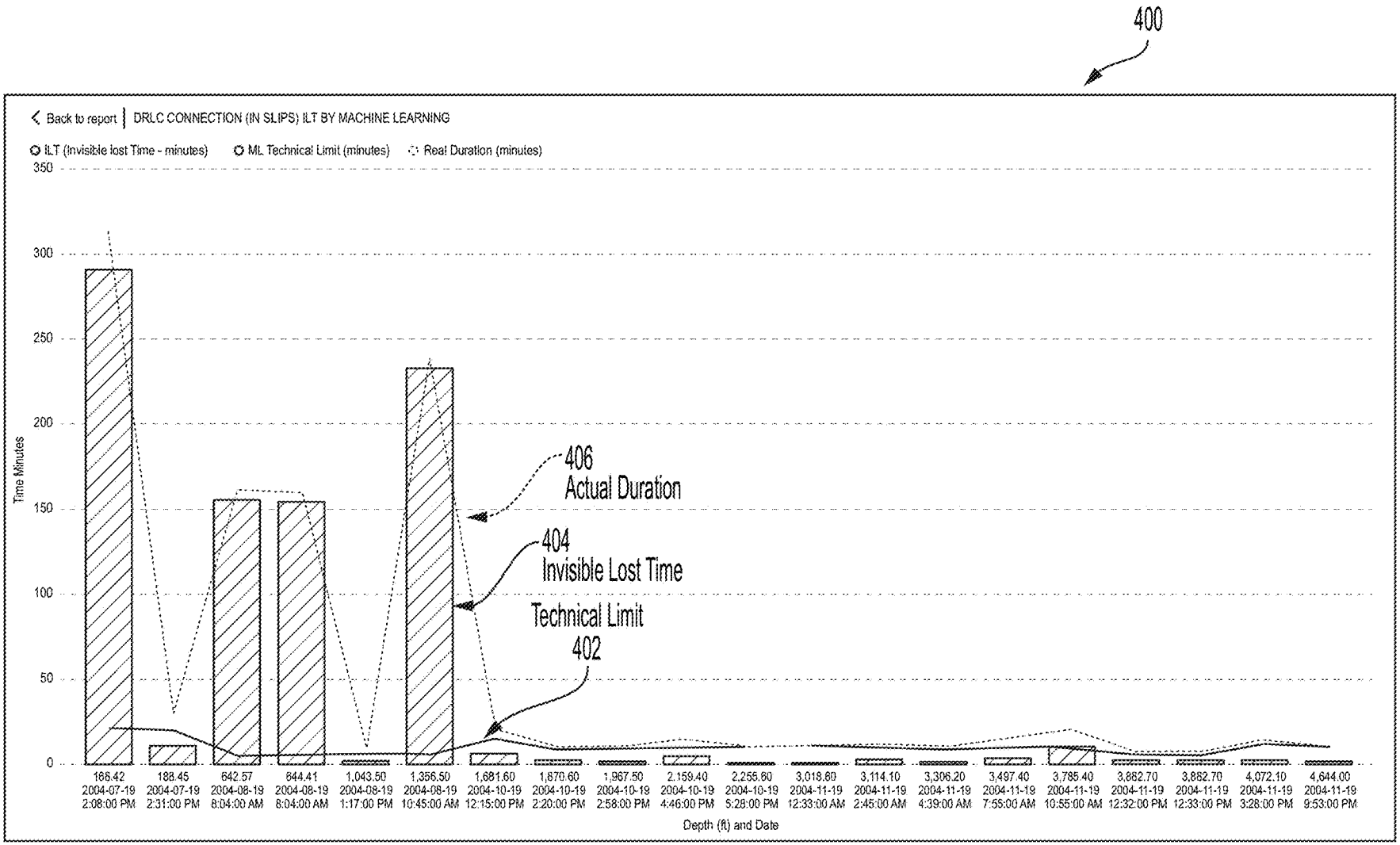
FIG. 4 is a graph of a technical limit and invisible lost time calculation according to one example of the present disclosure.

FIG. 4 is a graph 400 of a technical limit 402 and invisible lost time 404 calculation according to one example of the present disclosure. A forest regression may be performed to obtain multiple variations of the technical limit 402 from real-time data for a drilling operation. The evaluation results may be on drilling in slips activity, such as in FIG. 4.

A machine-learning algorithm, such as the machine-learning algorithm 211 in FIG. 2, can determine correlations between real-time data and historic daily drilling operation reports to determine the technical limit 402. The correlation analysis can be performed for data variables such as real-time variables, a well directional plan, geology and geophysics data, section or planned phases, tortuosity, BHA technology, non-productive time reports near to real time, rig variables, or crew scheduling.

Data adjustments (e.g., replacement) can be performed for the data variables during the correlation analysis for lost connections to determine an accurate technical limit variation over time and depth. For example, the data adjustment process may use the correlations determined from the historic drilling reports, the real-time data, and other data variables that are associated with a depth of the wellbore to replace lost data in the real-time data. The difference between the actual duration 406 of the drilling operation and the technical limit 402 results in the invisible lost time 404 calculation approximation.

Figure 5:
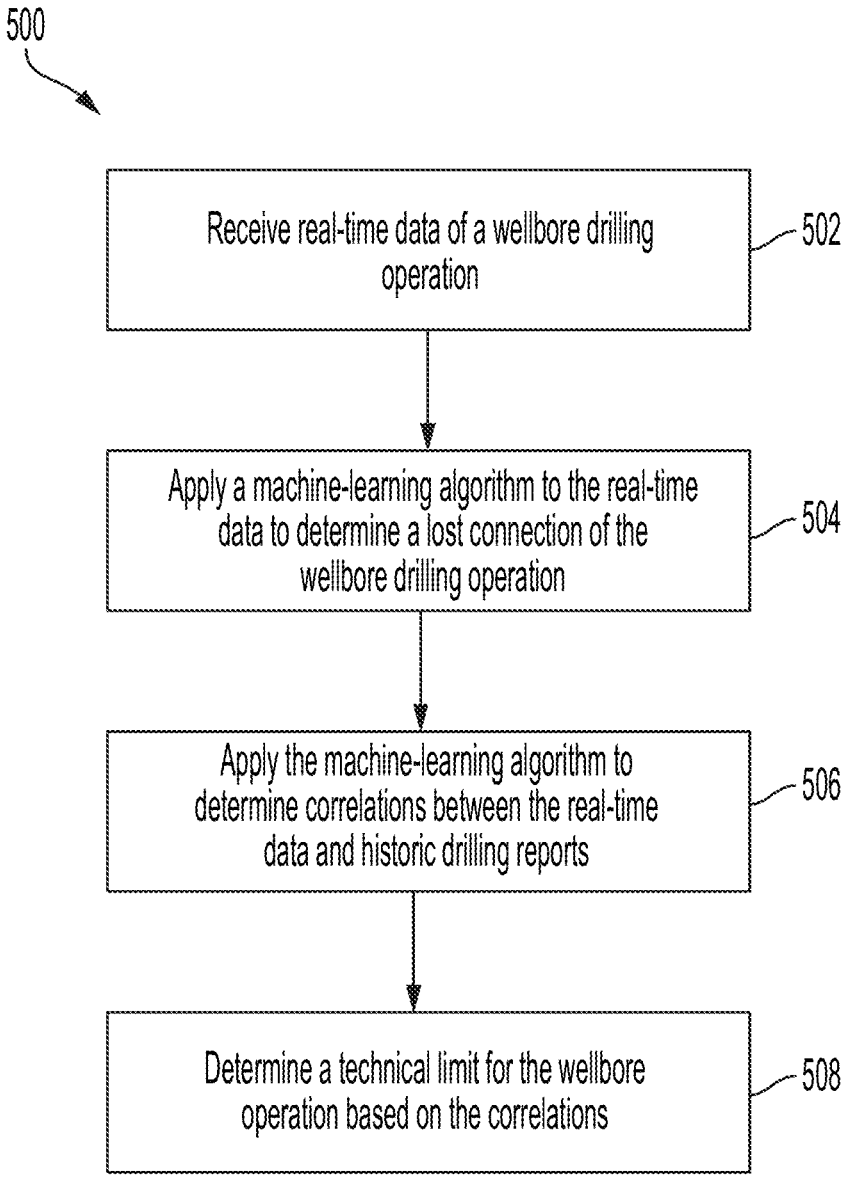
FIG. 5 is a flow chart for determining a technical limit for a drilling operation using a machine-learning algorithm according to one example of the present disclosure.

FIG. 5 is a flow chart of a process 500 for determining a technical limit for a drilling operation using a machine-learning algorithm according to one example of the present disclosure. A processor, such as the processor 204 in FIG. 2, can perform the operations of the flow chart. Other examples can involve more operations, fewer operations, different operations, or a different order of the operations shown in FIG. 5.

At block 502, the processor can receive real-time data of a wellbore drilling operation. The real-time data can be received from sensors and other computing devices included in a wellbore drilling system. The real-time data can include measurements such as azimuth, temperature, pressure, revolutions per minute, torque on bit, weight on bit, or a combination thereof. The real-time data can be used to determine a quantity and duration of connections during the wellbore drilling operation.

At block 504, the processor can apply a machine-learning algorithm to the real-time data to determine lost connections of the wellbore drilling operation. The machine-learning algorithm may determine where gaps exist in the real-time data to determine the lost connections.

At block 506, the processor can apply the machine-learning algorithm to determine correlations between the real-time data and historic drilling data. The correlations may be based on variables such as real-time variables, a depth of the wellbore, a well directional plan, geology and geophysics data, section or planned phases, tortuosity, BHA technology, non-productive time reports near to real time, rig variables, or crew scheduling. As discussed above, the machine-learning algorithm may use the correlations to fill the gaps or lost data in the real-time data with predicted data, which can be used to determine the technical limit.

At block 508, the processor can determine the technical limit for the wellbore drilling operation based on the correlations. The technical limit may further be used to determine the actual duration of the drilling operation and an accurate ILT for the wellbore drilling operation. The accurate ILT can allow a user to determine operations for reducing the invisible lost time of the wellbore drilling operation. The computing device can determine the operations for reducing the ILT, and can output a command for causing the operations to be implemented either automatically or by selection from a user.

In some aspects, a system, a method, and an apparatus for determining a technical limit of the wellbore drilling operation are provided according to one or more of the following examples:

Example 1 is a system comprising: a processing device; and a memory device that includes instructions executable by the processing device for causing the processing device to: receive real-time data of a wellbore drilling operation; apply a machine-learning algorithm to the real-time data to determine a lost connection of the wellbore drilling operation; apply the machine-learning algorithm to determine correlations between the real-time data and historic drilling reports; and determine a technical limit for the wellbore drilling operation based on the correlations.

Example 2 is the system of example 1, wherein the memory device further includes instructions executable by the processing device for causing the processing device to determine a total minimal connection, an invisible lost time, a conventional non-productive time, a perfect well time, or a combination thereof for the wellbore drilling operation based on the technical limit.

Example 3 is the system of examples 1-2, wherein the memory device further includes instructions executable by the processing device for causing the processing device to output a command to cause an adjustment of the wellbore drilling operation based on the invisible lost time.

Example 4 is the system of examples 1-3, wherein the technical limit varies during the wellbore drilling operation based on a depth of a wellbore.

Example 5 is the system of examples 1-4, wherein the memory device further includes instructions executable by the processing device for causing the processing device to: determine the technical limit for the depth of the wellbore is outside of a predefined range; and in response to determining the technical limit for the depth is outside of the predefined range, output the command to cause the adjustment of the wellbore drilling operation.

Example 6 is the system of examples 1-5, wherein the technical limit corresponds to a first technical limit for a first depth plane of the wellbore and the memory device further includes instructions executable by the processing device for causing the processing device to determine additional technical limits each of the additional technical limits corresponding to another depth plane of the wellbore.

Example 7 is the system of examples 1-6, wherein the memory device further includes instructions executable by the processing device for causing the processing device to generate drilling data for the lost connection based on the correlations and the historic drilling reports.

Example 8 is the system of examples 1-7, wherein the correlations comprise one or more of real-time variable correlations, well directional plan correlations, geology and geophysics data correlations, tortuosity correlations, or rig variable correlations.

Example 9 is a method comprising: receiving real-time data of a wellbore drilling operation; applying a machine-learning algorithm to the real-time data to determine a lost connection of the wellbore drilling operation; applying the machine-learning algorithm to determine correlations between the real-time data and historic drilling reports; and determining a technical limit for the wellbore drilling operation based on the correlations.

Example 10 is the method of example 9, further comprising determining a total minimal connection, an invisible lost time, a conventional non-productive time, a perfect well time, or a combination thereof for the wellbore drilling operation based on the technical limit.

Example 11 is the method of examples 9-10, further comprising outputting a command to cause an adjustment of the wellbore drilling operation based on the invisible lost time.

Example 12 is the method of examples 9-11, wherein the technical limit varies during the wellbore drilling operation based on a depth of a wellbore.

Example 13 is the method of examples 9-12, further comprising: determining the technical limit for the depth of the wellbore is outside of a predefined range; and in response to determining the technical limit for the depth is outside of the predefined range, output the command to cause the adjustment of the wellbore drilling operation.

Example 14 is the method of examples 9-13, wherein the technical limit corresponds to a first technical limit for a first depth plane of the wellbore, and further comprising determining additional technical limits each of the additional technical limits corresponding to another depth plane of the wellbore.

Example 15 is the method of examples 9-14, further comprising generating drilling data for the lost connection based on the correlations and the historic drilling reports.

Example 16 is a non-transitory computer-readable medium comprising instructions that are executable by a processing device for causing the processing device to perform operations comprising: receiving real-time data of a wellbore drilling operation; applying a machine-learning algorithm to the real-time data to determine a lost connection of the wellbore drilling operation; applying the machine-learning algorithm to determine correlations between the real-time data and historic drilling reports; and determining a technical limit for the wellbore drilling operation based on the correlations.

Example 17 is the non-transitory computer-readable medium of example 16, further comprising: determining a total minimal connection, an invisible lost time, a conventional non-productive time, a perfect well time, or a combination thereof for the wellbore drilling operation based on the technical limit.

Example 18 is the non-transitory computer-readable medium of example 16-17, further comprising outputting a command to cause an adjustment of the wellbore drilling operation based on the invisible lost time.

Example 19 is the non-transitory computer-readable medium of example 16-18, wherein the technical limit varies during the wellbore drilling operation based on a depth of a wellbore.

Example 20 is the non-transitory computer-readable medium of examples 16-19, further comprising: determining the technical limit for the depth of the wellbore is outside of a predefined range; and in response to determining the technical limit for the depth is outside of the predefined range, output the command to cause the adjustment of the wellbore drilling operation.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processing device; and a memory device that includes instructions executable by the processing device for causing the processing device to:

receive real-time data of a wellbore drilling operation;

apply a machine-learning algorithm to the real-time data to determine a lost connection of the wellbore drilling operation;

apply the machine-learning algorithm to determine correlations between the real-time data and historic drilling reports;

determine a technical limit for a depth plane of a wellbore of the wellbore drilling operation based on the correlations;

determine the technical limit for the depth plane is outside a predefined range; and in response to determining the technical limit for the depth plane is outside of the predefined range, control the wellbore drilling operation by causing an adjustment of the wellbore drilling operation based on an invisible lost time for the wellbore drilling operation.

2. The system of claim 1, wherein the memory device further includes instructions executable by the processing device for causing the processing device to determine a total minimal connection, the invisible lost time, a conventional non-productive time, a perfect well time, or a combination thereof for the wellbore drilling operation based on the technical limit.

3. The system of claim 2, wherein the memory device further includes instructions executable by the processing device for causing the processing device to output a command to cause the adjustment of the wellbore drilling operation based on the invisible lost time.

4. The system of claim 1, wherein the technical limit varies during the wellbore drilling operation based on a depth of the wellbore.

5. The system of claim 1, wherein the technical limit corresponds to a first technical limit for a first depth plane of the wellbore and the memory device further includes instructions executable by the processing device for causing the processing device to determine additional technical limits each of the additional technical limits corresponding to another depth plane of the wellbore.

6. The system of claim 1, wherein the memory device further includes instructions executable by the processing device for causing the processing device to generate drilling data for the lost connection based on the correlations and the historic drilling reports.

7. The system of claim 1, wherein the correlations comprise one or more of real-time variable correlations, well directional plan correlations, geology and geophysics data correlations, tortuosity correlations, or rig variable correlations.

8. The system of claim 1, wherein the memory device further includes instructions executable by the processing device for causing the processing device to output a command to cause the adjustment to drilling equipment for the wellbore drilling operation.

9. A method comprising:

receiving real-time data of a wellbore drilling operation;

applying a machine-learning algorithm to the real-time data to determine a lost connection of the wellbore drilling operation;

applying the machine-learning algorithm to determine correlations between the real-time data and historic drilling reports;

determining a technical limit for a depth plane of a wellbore of the wellbore drilling operation based on the correlations;

determining the technical limit for the depth plane is outside a predefined range; and in response to determining the technical limit for the depth plane is outside of the predefined range, controlling the wellbore drilling operation by causing an adjustment of the wellbore drilling operation based on an invisible lost time for the wellbore drilling operation.

10. The method of claim 9, further comprising determining a total minimal connection, the invisible lost time, a conventional non-productive time, a perfect well time, or a combination thereof for the wellbore drilling operation based on the technical limit.

11. The method of claim 10, further comprising outputting a command to cause the adjustment of the wellbore drilling operation based on the invisible lost time.

12. The method of claim 9, wherein the technical limit varies during the wellbore drilling operation based on a depth of the wellbore.

13. The method of claim 9, wherein the technical limit corresponds to a first technical limit for a first depth plane of the wellbore, and further comprising determining additional technical limits each of the additional technical limits corresponding to another depth plane of the wellbore.

14. The method of claim 9, further comprising generating drilling data for the lost connection based on the correlations and the historic drilling reports.

15. A non-transitory computer-readable medium comprising instructions that are executable by a processing device for causing the processing device to perform operations comprising:

receiving real-time data of a wellbore drilling operation;

applying a machine-learning algorithm to the real-time data to determine a lost connection of the wellbore drilling operation;

applying the machine-learning algorithm to determine correlations between the real-time data and historic drilling reports;

determining a technical limit for a depth plane of a wellbore of the wellbore drilling operation based on the correlations;

determining the technical limit for the depth plane is outside a predefined range; and in response to determining the technical limit for the depth plane is outside of the predefined range, controlling the wellbore drilling operation by causing an adjustment of the wellbore drilling operation based on an invisible lost time for the wellbore drilling operation.

16. The non-transitory computer-readable medium of claim 15, further comprising instructions that are executable by the processing device for causing the processing device to perform operations comprising:

determining a total minimal connection, the invisible lost time, a conventional non-productive time, a perfect well time, or a combination thereof for the wellbore drilling operation based on the technical limit.

17. The non-transitory computer-readable medium of claim 16, further comprising instructions that are executable by the processing device for causing the processing device to perform operations comprising:

outputting a command to cause the adjustment of the wellbore drilling operation based on the invisible lost time.

18. The non-transitory computer-readable medium claim 15, wherein the technical limit varies during the wellbore drilling operation based on a depth of the wellbore.

* * * * *